US007409778B2

(12) United States Patent
Steidle

(10) Patent No.: US 7,409,778 B2
(45) Date of Patent: Aug. 12, 2008

(54) HANG TABS FOR FOOTWEAR

(75) Inventor: William Steidle, New York, NY (US)

(73) Assignee: Wiesner Products, Inc., New York, NY (US)

( * ) Notice: Subject to any disclaimer, the term of this patent is extended or adjusted under 35 U.S.C. 154(b) by 415 days.

(21) Appl. No.: 11/350,677

(22) Filed: Feb. 8, 2006

(65) Prior Publication Data

US 2006/0123659 A1 Jun. 15, 2006

Related U.S. Application Data

(63) Continuation of application No. 10/753,700, filed on Jan. 8, 2004, now abandoned.

(51) Int. Cl.
*A43B 3/00* (2006.01)
*G09F 23/00* (2006.01)
*B65D 85/18* (2006.01)

(52) U.S. Cl. ..... 36/1; 40/636; 206/278

(58) Field of Classification Search ..... 36/1, 36/7.5, 11.5, 7.6, 138; 40/636; 206/278
See application file for complete search history.

(56) References Cited

U.S. PATENT DOCUMENTS

D133,260 S * 8/1942 Timson ..... D2/918
2,469,708 A * 5/1949 Alexander ..... 36/11.5
3,040,451 A * 6/1962 Hilkemeyer ..... 36/7.5
3,482,335 A * 12/1969 Ornsteen ..... 36/1
4,194,310 A * 3/1980 Bowerman ..... 36/128
4,624,060 A * 11/1986 Maxwell ..... 36/1
5,410,821 A * 5/1995 Hilgendorf ..... 36/100
6,029,376 A * 2/2000 Cass ..... 36/50.1

FOREIGN PATENT DOCUMENTS

EP 0079572 A1 * 5/1983

* cited by examiner

*Primary Examiner*—Ted Kavanaugh
(74) *Attorney, Agent, or Firm*—Ezra Sutton

(57) ABSTRACT

Footwear having plastic or rubber soles and having molded protruding hang tabs from the soles for use in the pairing of footwear together. Each sole having a plurality of protruding hang tabs molded at spaced-apart positions along a perimeter edging of the sole. The plurality of hang tabs includes a first hang tab positioned on the toe end of the sole, a second hang tab positioned on the heel end of the sole, a third hang tab positioned on the inside section of the sole, and/or a fourth hang tab positioned on the outside section of the sole. One or more of the hang tabs have plastic fasteners and the like attached thereto for connecting a pair of the soles together. The hang tabs are being removable from the soles after purchase by cutting off each hang tab from the perimeter edging of the sole.

48 Claims, 8 Drawing Sheets

HANG TABS FOR FOOTWEAR

RELATED APPLICATION

This application is a continuation of U.S. patent application Ser. No. 10/753,700 filed Jan. 8, 2004 now abandoned.

FIELD OF INVENTION

The present invention relates to footwear having molded plastic or rubber soles having hang tabs thereon. More particularly, the molded plastic or rubber soles have integrally protruding tabs at various positions on each sole for receiving fasteners or hangers for either connecting or hanging the footwear or slippers together, or for attaching price tags to the protruding hanging tabs. The hanging tabs are cut off after the purchase of the footwear by the consumer.

BACKGROUND OF THE INVENTION

Fastening systems for attaching together mated pairs of shoes, boots, slippers, laceless sneakers, etc. offered for sale are well known in the art. In the mass merchandising of relatively inexpensive shoes by self-service department stores, discount stores, factory outlets, and the like, it is common practice to fasten the mated shoes of a pair together, to prevent their separation and possible mismatching. The price tag is usually attached at the same time. This is customarily done by means of a thin strong plastic filament about 8 or 10 inches long having locking means for joining the ends together. In the case of shoes having straps or buckles or eyelets for shoe laces or vents or the like, there is no problem fastening the shoes together because the locking filament may easily be inserted through one of the available apertures on each of the shoes. The filament is passed through a hole in the price tag and the ends are locked together. Some shoes, however, do not have any available aperture or eyelet. It has been the practice to pierce the side of the shoe in order to thread the connecting filament through it. This leaves an undesirable and unsightly blemish or mark after the filament is cut and removed, after purchase of the shoes, boots, slippers, etc. have been made.

There remains a need for protruding hanging tabs on footwear, laceless sneakers or slippers having molded plastic or rubber soles, wherein the integrally protruding hanging tabs on the molded plastic or rubber soles are used for receiving fasteners or hanging display cards thereon. Additionally, the protruding hanging tabs are used for either connecting or hanging the footwear or slippers together, or for attaching price tags to the protruding hanging tabs.

DESCRIPTION OF THE PRIOR ART

Fastening systems, shoe interconnecting means, shoe fastener devices for the pairing of shoes together and the like having various designs, configurations, structures and materials of construction have been disclosed in the prior art. For example, U.S. Pat. No. 3,482,335 to ORNSTEEN discloses an elongated tab affixed to a shoe and adapted to be connected to a like tab on another shoe of a pair to securely fasten the shoes together. The tabs may be interconnected by staples, snap fasteners or other suitable means. The free ends of the tabs or the connected tabs on a pair of shoes are adapted to also be connected to a price tag or advertising information. This prior art patent does not disclose or teach the design, configuration or structure of the protruding hang tabs for footwear of the present invention.

U.S. Pat. No. 4,624,060 to MAXWELL discloses shoes with a fastening tab inside the shoe. The tab comprises a length of narrow strong sheet material having a hole or loop at one end for receiving a fastening filament. The fastening tab is folded and disposed with one portion having the hole or loop at its end extending vertically up from the sole along the inside wall of the inner portion of the shoe but not attached to the shoe wall. The other portion of the fastening tab is secured by means of strong adhesive, stitching, staples, or all three, to the bottom sole of the shoe and the inner sole applied on top of the adhered portion of the fastening tab. The shoes are fastened together by passing a filamentary connector, preferably a locking plastic fastener, through the hole or loop in each of the fastening tabs and through the price tag before joining the ends together in a closed loop. This prior art patent does not disclose or teach the design, configuration or structure of the protruding hang tabs for footwear of the present invention.

U.S. Pat. No. 6,003,212 to IMAHATA discloses a fastener for a pair of shoes for releasably coupling at least one pair of shoes together. The fastener includes a male portion and a female portion that are releasably connected. The male portion has a neck member outwardly extending from the front face thereof and a bulbous end portion extending from the next member. The female portion has an aperture extending through its top and bottom faces and a pair of axial breaks providing an opening through the front face of the female portion of the aperture. The end and neck members of the male portion are slidably insertable in the groove of the female portion. The male portion is coupled to an inner side of a shoe. The female portion is coupled to an inner side of another shoe. This is accomplished by stitching using a strong thread or similar material. This prior art patent does not disclose or teach the design, configuration or structure of the protruding hang tabs for footwear of the present invention.

None of these prior art patents teach or disclose the structure of a plastic or rubber sole of a shoe, a slipper and the like incorporating a protruding hang tab on the toe end section, heel end section, in-step section and/or arch section of the sole as shown in the present invention. The prior art patents include side connector tabs that are glued, stitched, or stapled to the sole of the footwear but are not molded to the sole of the footwear.

Accordingly, it is an object of the present invention to provide protruding hang tabs for footwear having molded plastic or rubber soles thereon, wherein the integrally attached protruding hang tabs on the molded plastic or rubber soles are used for receiving fasteners or hangers and/or display cards thereon.

Another object of the present invention is to provide protruding hang tabs for footwear that are used for either connecting or hanging the paired footwear or slippers together, or for attaching price tags to the protruding hang tabs.

Another object of the present invention is to provide protruding hang tabs for footwear that are easily cut-off and removed from the sole of the footwear or slipper after the completion of the sale by the consumer leaving little or no visible remnant in the separated footwear or slippers.

Another object of the present invention is to provide protruding hang tabs which are of durable and reliable construction for the easy addition of swiftach fasteners, tie and tag fasteners and/or chip display cards to the protruding hang tabs according to the display needs of the consumer, store or manufacturer.

Another object of the present invention is to provide protruding hang tabs for releasably pairing of at least one pair of shoes, slippers, etc. together in a side by side configuration or in a back to back configuration.

Another object of the present invention is to provide protruding hang tabs that help to keep the footwear organized by permitting two or more paired footwear to be coupled together on a single display card.

Another object of the present invention is to provide protruding hang tabs that have geometrically-shaped designs such as a semi-circular shape, a rectangular-shape, a triangular-shape, or an oval-shape.

Another object of the present invention is to provide protruding hang tabs for footwear selected from the group consisting of shoes, slippers, boots, laceless sneakers, booties, and other miscellaneous footwear.

A further object of the present invention is to provide protruding hang tabs for footwear that can be mass produced in an automated and economical manner and are readily affordable by the store owner or manufacturer.

SUMMARY OF THE INVENTION

In accordance with the present invention there is provided footwear having plastic or rubber soles and having molded protruding hang tabs on the soles for use in the pairing of footwear together. The plurality of protruding hang tabs on each sole are molded at spaced-apart positions along a perimeter edging of the sole. The plurality of hang tabs includes a first hang tab positioned on the toe end of the sole, a second hang tab positioned on the heel end of the sole, a third hang tab positioned on the inside section of the sole, and/or a fourth hang tab positioned on the outside section of the sole. One or more of the hang tabs have plastic fasteners attached thereto for connecting a pair of the soles together. The hang tabs are removable from the soles after purchase by cutting off each hang tab from the perimeter edging of the sole.

BRIEF DESCRIPTION OF DRAWINGS

Further objects, features, and advantages of the present invention will become apparent upon the consideration of the following detailed description of the presently-preferred embodiment when taken in conjunction with the accompanying drawings, wherein.

DETAILED DESCRIPTION OF THE PREFERRED AND ALTERNATE EMBODIMENTS

Figure 1:
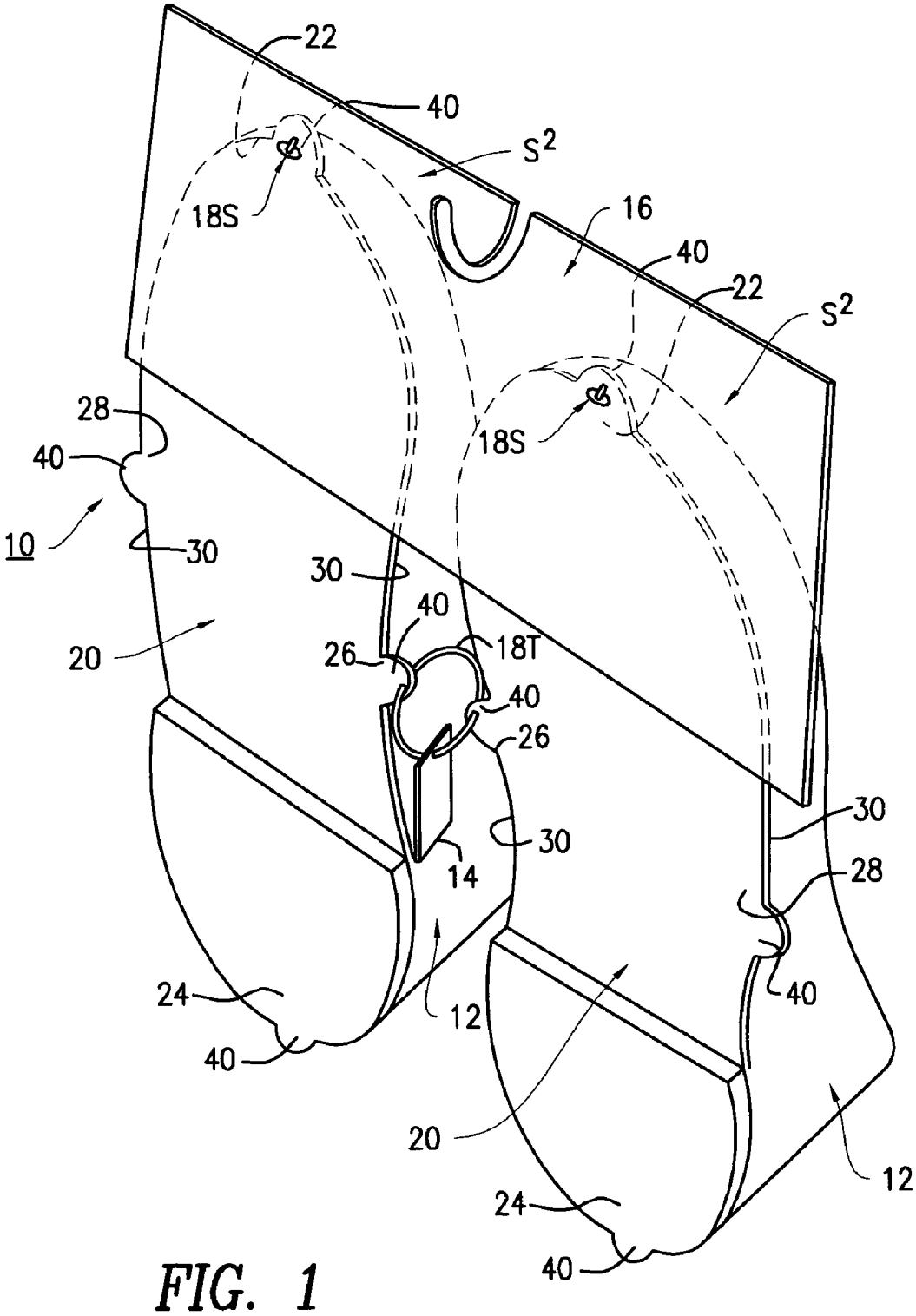
FIG. 1 is a rear perspective view of the hang tabs for footwear of the preferred embodiment of the present invention showing two shoes hanging together in a side by side configuration on a display card with a swiftach on the toe section hang tabs.
Figure 2:
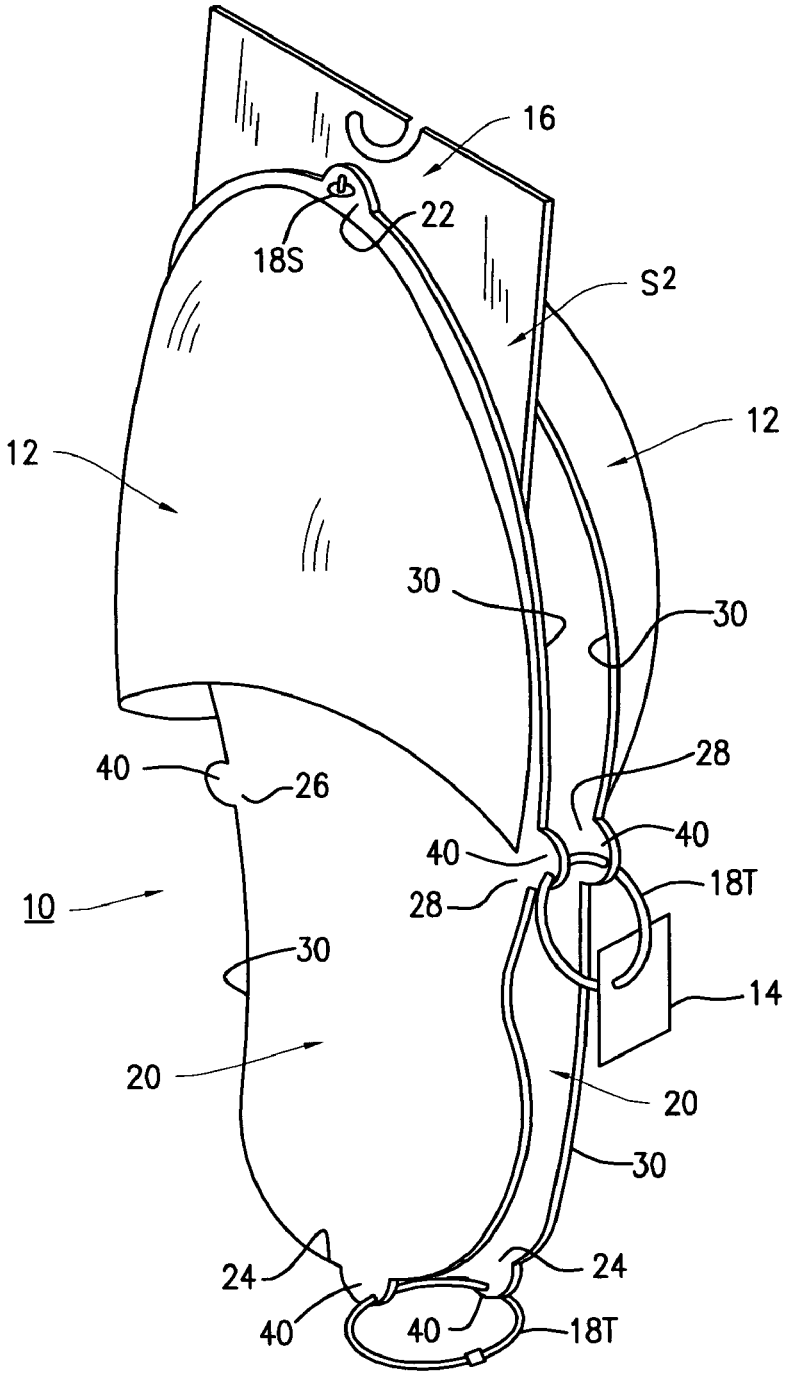
FIG. 2 is a front perspective view of the hang tabs for footwear of the preferred embodiment of the present invention showing two shoes hanging together in a back to back configuration on a display card with a swiftach on the toe and heel section hang tabs.

The protruding hang tabs 10 for footwear 12 and their component parts of the preferred and alternate embodiments of the present invention are represented in detail by FIGS. 1 through 12 of the patent drawings. The protruding hang tabs 10 are used for connecting and/or hanging paired footwear 12 together, or for attaching price tags 14 or display cards 16 to protruding hang tabs 10, as depicted in FIGS. 1 and 2 of the drawings.

Figure 3:
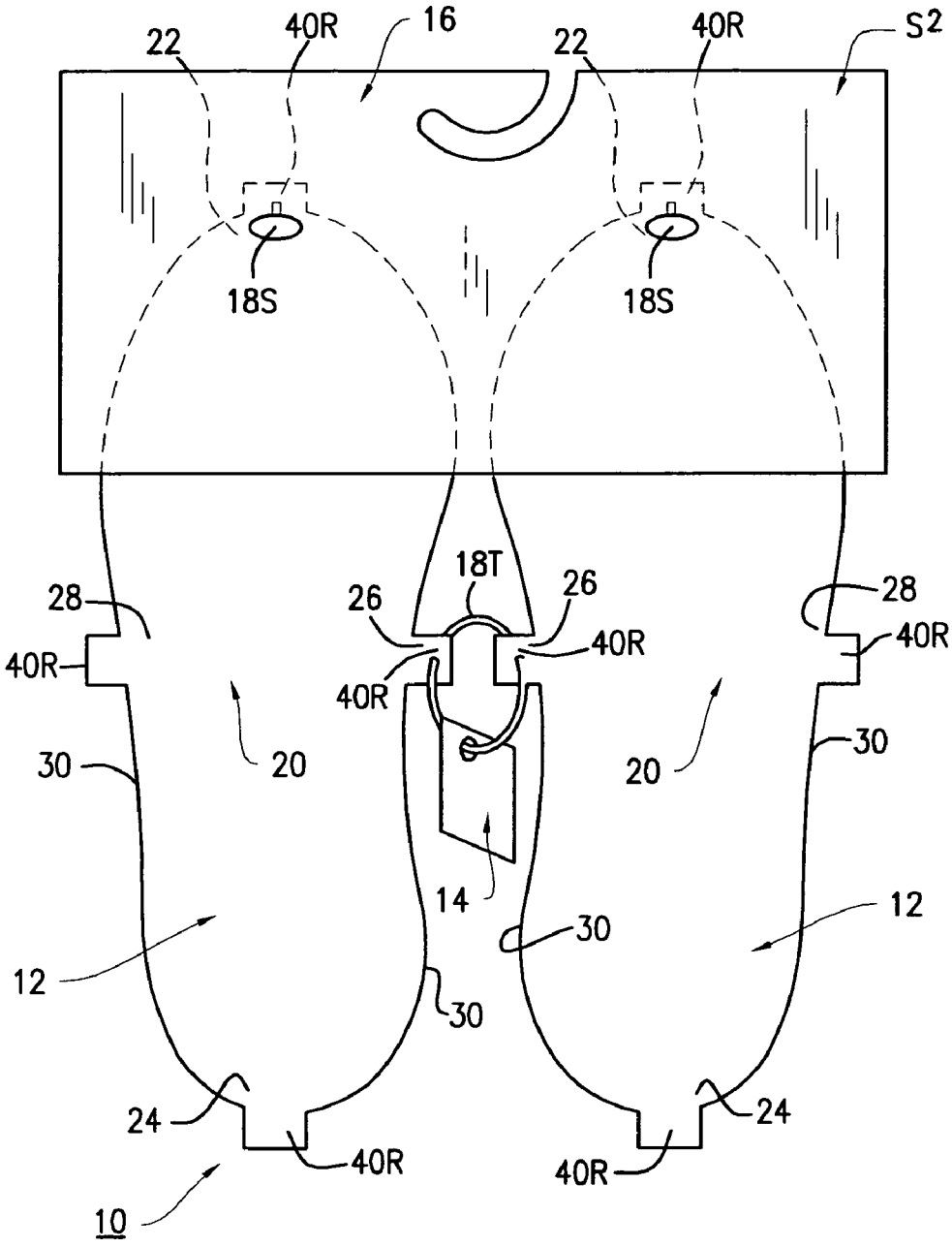
FIG. 3 is a bottom plan view of the hang tabs for footwear of the present invention showing the hang tabs having a rectangular-shaped configuration.
Figure 4:
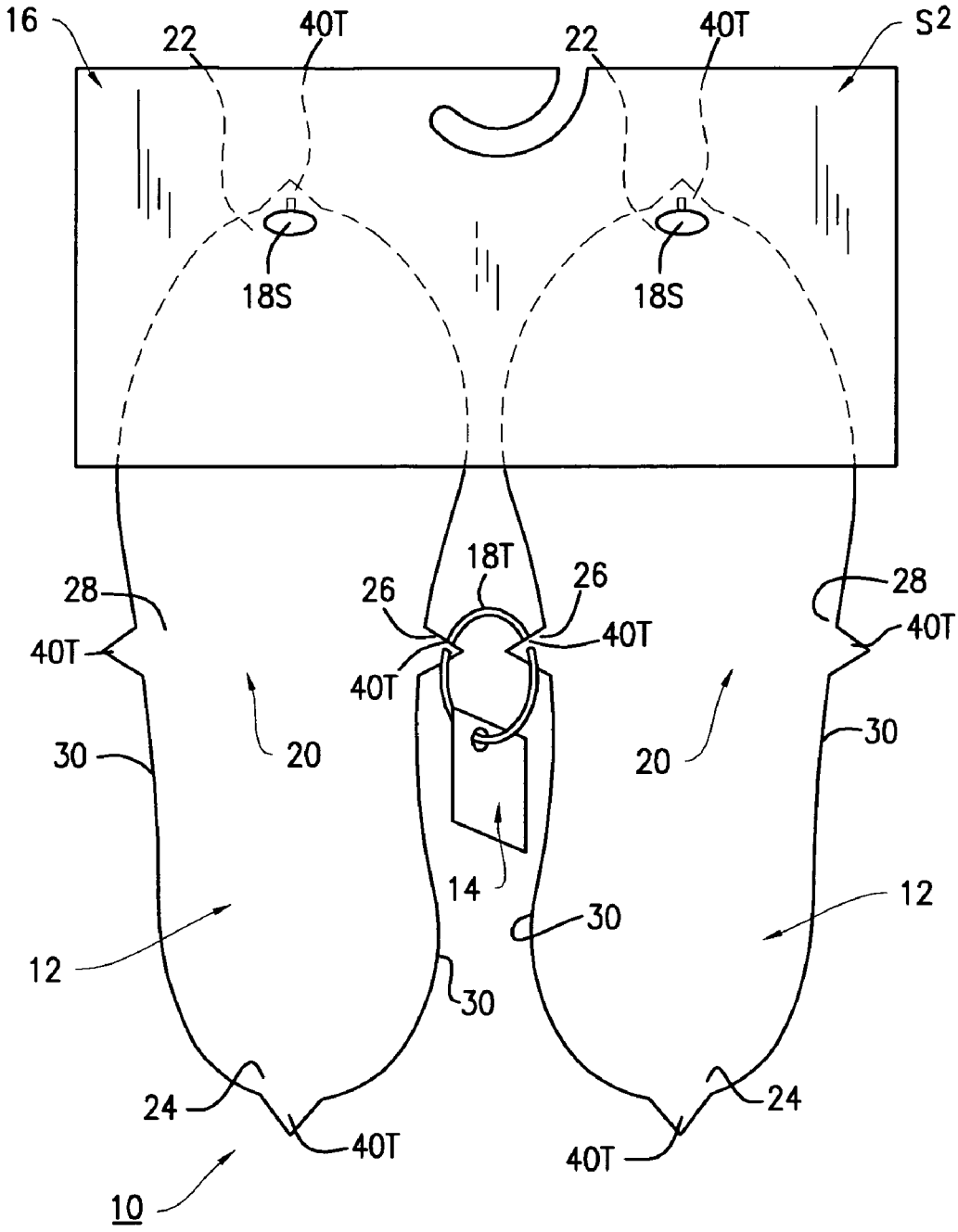
FIG. 4 is a bottom plan view of the hang tabs for footwear of the present invention showing the hang tabs having a triangular-shaped configuration.

As shown in FIGS. 1 and 2, the protruding hang tabs 10 each include a semi-circularly shaped tab member 40 being positioned at various locations on the perimeter edging 30 of a sole section/member 20 of the footwear 12. The tab members 40 can be located and positioned on a toe end 22, on a heel end 24, on an in-step or inside section 26 and/or on an arch or outside section 28 along the perimeter edging 30 of the sole member 20 of footwear 12. Tab members 40 of protruding hang tabs 10 are in the same horizontal plane P as the sole member 20 of footwear 12, as shown in FIGS. 1 and 2. It is understood that the tab members 40 and the sole section 20 are molded together in one operation and are made from the same plastic or rubber material. Footwear 12 is selected from the group consisting of shoes, slippers, boots, laceless sneakers, booties and other miscellaneous footwear. As shown in FIGS. 3 and 4, the tab members 40 of the protruding hang tabs 10 can include other geometrically shaped designs such as a rectangular-shaped tab 40R, a triangular-shaped tab 40T, an oval-shaped tab, and the like.

First Alternate Embodiment 100

Figure 5:
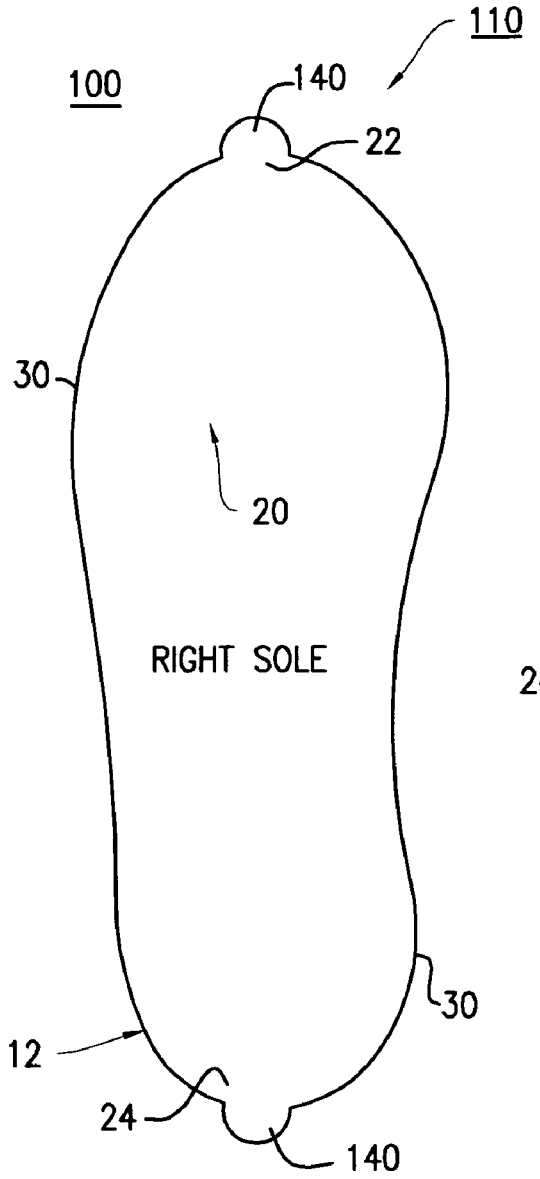
FIG. 5 is a bottom plan view of the hang tabs for footwear of the first alternate embodiment of the present invention showing the hang tabs positioned on the toe section and heel end section of a sole of a right shoe.

The protruding hang tabs 110 for footwear 12 and their component parts of the first alternate embodiment 100 are shown in FIG. 5 of the drawings. The elements illustrated in FIG. 5 which correspond to the elements described above with reference to FIGS. 1 and 2 have been designated by corresponding reference numbers being increased by one hundred. The first alternate embodiment 100 is constructed and operates in the same manner as the preferred embodiment 10, unless it is otherwise stated.

With reference to FIG. 5, the tab members 140 of the protruding hang tabs 110 are exactly the same as the preferred embodiment 10 except for the orientation of the tab members 140 on the sole section 20 of footwear 12. Tab members 140 are positioned on the toe end 22 and the heel end 24 of the sole section 20 of footwear 12.

Second Alternate Embodiment 200

Figure 6:
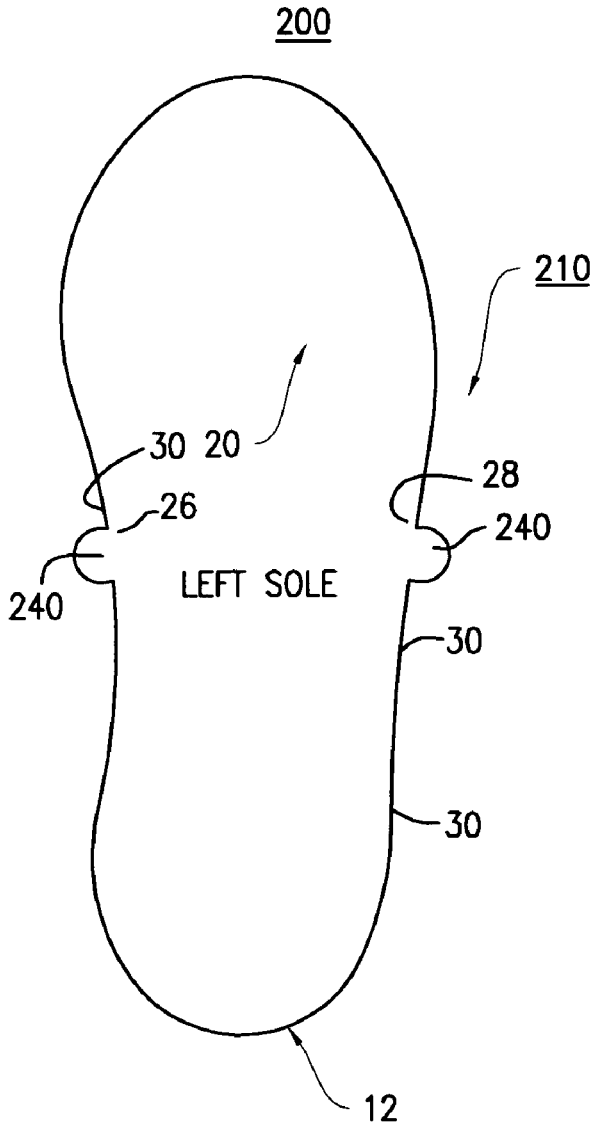
FIG. 6 is a bottom plan view of the hang tabs for footwear of the second alternate embodiment of the present invention showing the hang tabs positioned on the in-step section and arch section of the sole of a left shoe.

The protruding hang tabs 310 for footwear 12 and their component parts of the second alternate embodiment 200 are shown in FIG. 6 of the drawings. The elements illustrated in FIG. 6 which correspond to the elements described above with reference to FIGS. 1 and 2 have been designated by corresponding reference numbers being increased by two hundred. The second alternate embodiment 200 is constructed and operates in the same manner as the preferred embodiment 10, unless it is otherwise stated.

With reference to FIG. 6, the tab members 240 of the protruding hang tabs 210 are exactly the same as the preferred embodiment 10 except for the orientation of the tab members 240 on the sole section 20 of footwear 12. Tab members 240 are positioned on the inside section 26 and the outside section 28 of the sole section 20 of footwear 12.

Third Alternate Embodiment 300

Figure 7:
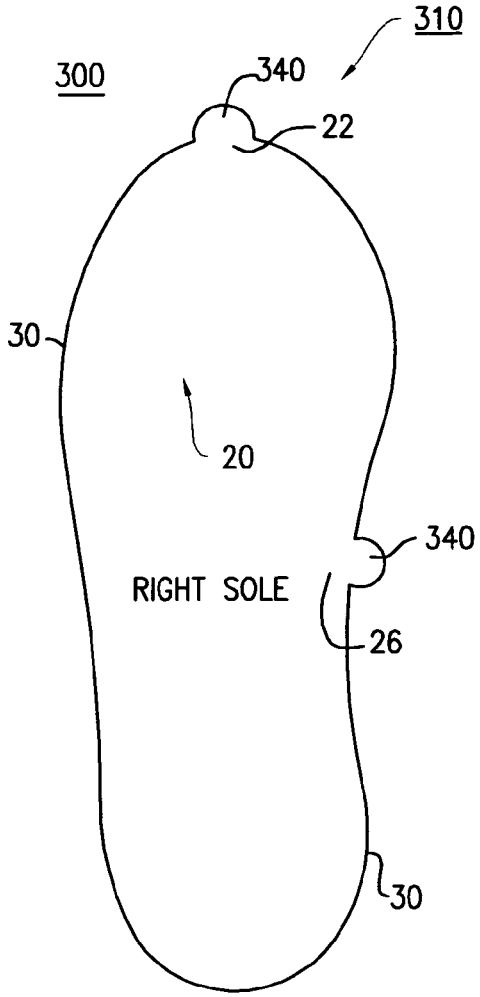
FIG. 7 is a bottom plan view of the hang tabs for footwear of the third alternate embodiment of the present invention showing the hang tabs positioned on the toe section and in-step section of a sole of the right shoe.

The protruding hang tabs 310 for footwear 12 and their component parts of the third alternate embodiment 300 are shown in FIG. 7 of the drawings. The elements illustrated in FIG. 7 which correspond to the elements described above with reference to FIGS. 1 and 2 have been designated by corresponding reference numbers being increased by three hundred. The third alternate embodiment 300 is constructed and operates in the same manner as the preferred embodiment 10, unless it is otherwise stated.

With reference to FIG. 7, the tab members 340 of the protruding hang tabs 310 are exactly the same as the preferred embodiment 10 except for the orientation of the tab members 340 on the sole section 20 of footwear 12. Tab members 340 are positioned on the toe end 22 and the inside section 26 of the sole section 20 of footwear 12.

Fourth Alternate Embodiment 400

Figure 8:
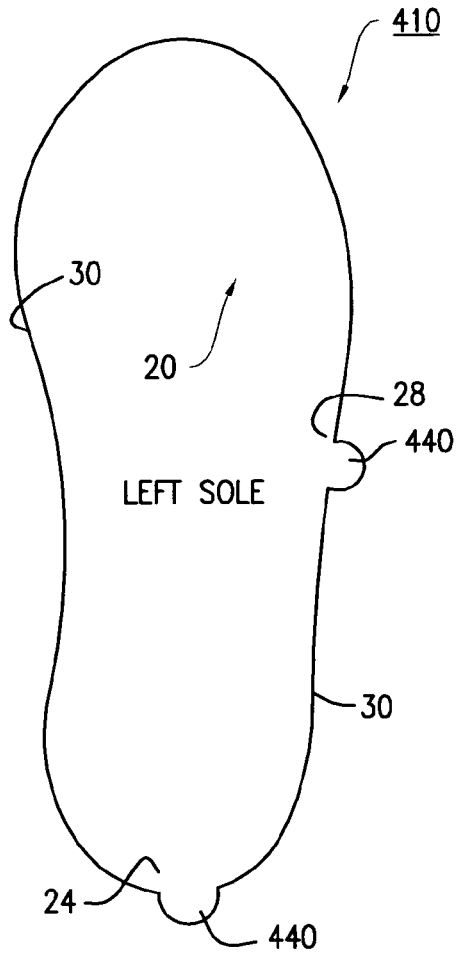
FIG. 8 is a bottom plan view of the hang tabs for footwear of the fourth alternate embodiment of the present invention showing the hang tabs positioned on the heel section and arch section of the sole of the left shoe.

The protruding hang tabs 410 for footwear 12 and their component parts of the fourth alternate embodiment 400 are shown in FIG. 8 of the drawings. The elements illustrated in FIG. 8 which correspond to the elements described above with reference to FIGS. 1 and 2 have been designated by corresponding reference numbers being increased by four hundred. The fourth alternate embodiment 400 is constructed and operates in the same manner as the preferred embodiment 10, unless it is otherwise stated.

With reference to FIG. 8, the tab members 440 of the protruding hang tabs 410 are exactly the same as the preferred embodiment 10 except for the orientation of the tab members 440 on the sole section 20 of footwear 12. Tab members 440 are positioned on the heel end 24 and the outside section 28 of the sole section 20 of footwear 12.

Fifth Alternate Embodiment 500

Figure 9:
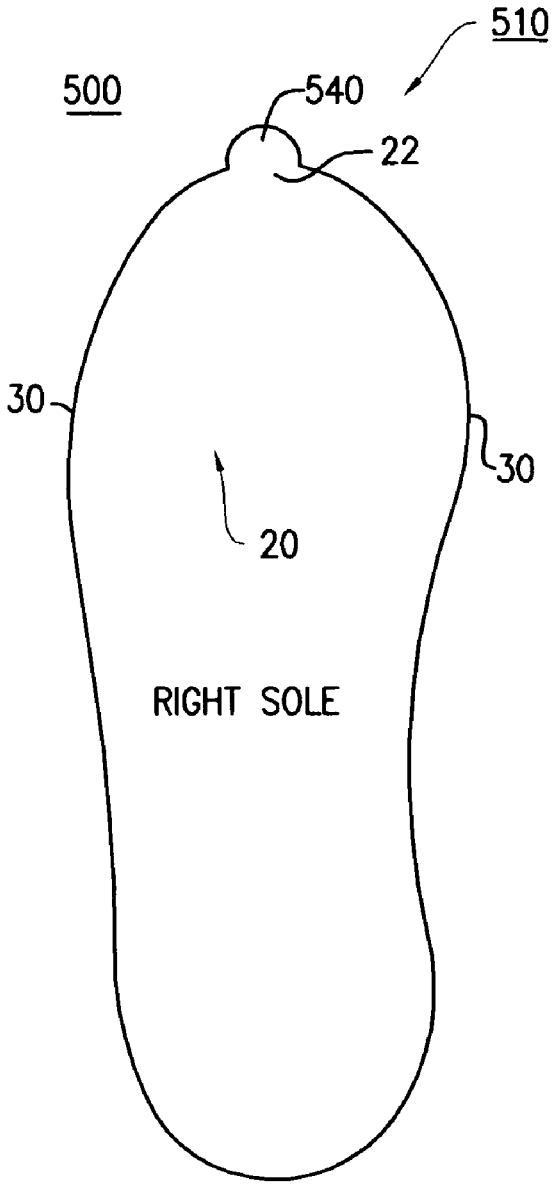
FIG. 9 is a bottom plan view of the hang tabs for footwear of the fifth alternate embodiment of the present invention showing the hang tab positioned on the toe section of the sole of the right shoe.

The protruding hang tabs 510 for footwear 12 and their component parts of the fifth alternate embodiment 500 is shown in FIG. 9 of the drawings. The elements illustrated in FIG. 9 which correspond to the elements described above with reference to FIGS. 1 and 2 have been designated by corresponding reference numbers being increased by five hundred. The fifth alternate embodiment 500 is constructed and operates in the same manner as the preferred embodiment 10, unless it is otherwise stated.

With reference to FIG. 9, the tab member 540 of the protruding hang tabs 510 are exactly the same as the preferred embodiment 10 except for the orientation of the tab member 540 on the sole section 20 of footwear 12. Tab member 540 is positioned on the toe end 22 of the sole section 20 of footwear 12.

Sixth Alternate Embodiment 600

Figure 10:
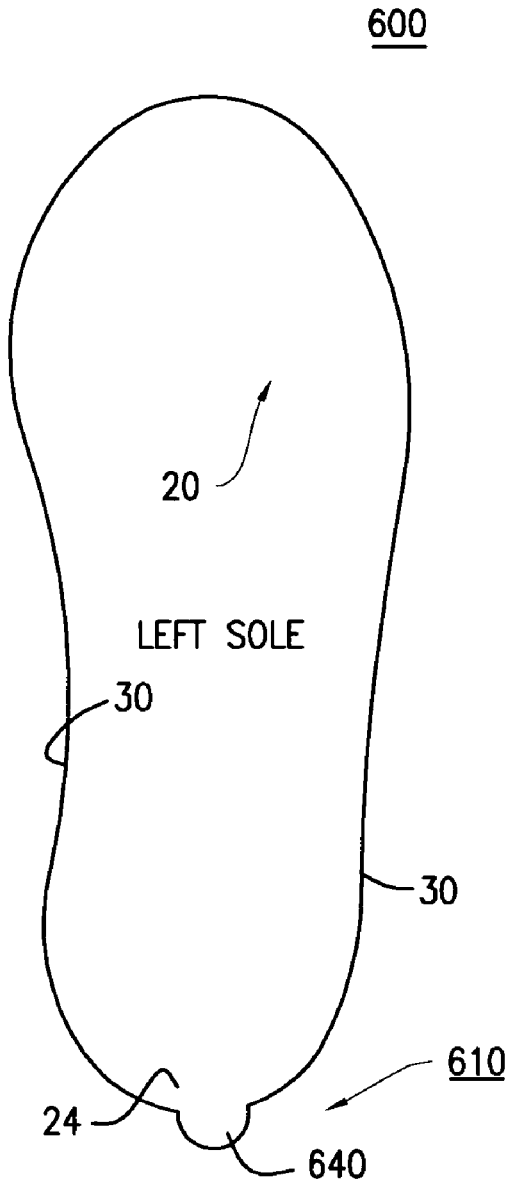
FIG. 10 is a bottom plan view of the hang tabs for footwear of the sixth alternate embodiment of the present invention showing the hang tab positioned on the heel section of the sole of the left shoe.

The protruding hang tabs 610 for footwear 12 and their component parts of the sixth alternate embodiment 600 is shown in FIG. 10 of the drawings. The elements illustrated in FIG. 10 which correspond to the elements described above with reference to FIGS. 1 and 2 have been designated by corresponding reference numbers being increased by six hundred. The sixth alternate embodiment 600 is constructed and operates in the same manner as the preferred embodiment 10, unless it is otherwise stated.

With reference to FIG. 10, the tab member 640 of the protruding hang tabs 610 are exactly the same as the preferred embodiment 10 except for the orientation of the tab member 640 on the sole section 20 of footwear 12. Tab member 640 is positioned on the heel end 24 of the sole section 20 of footwear 12.

Seventh Alternate Embodiment 700

Figure 11:
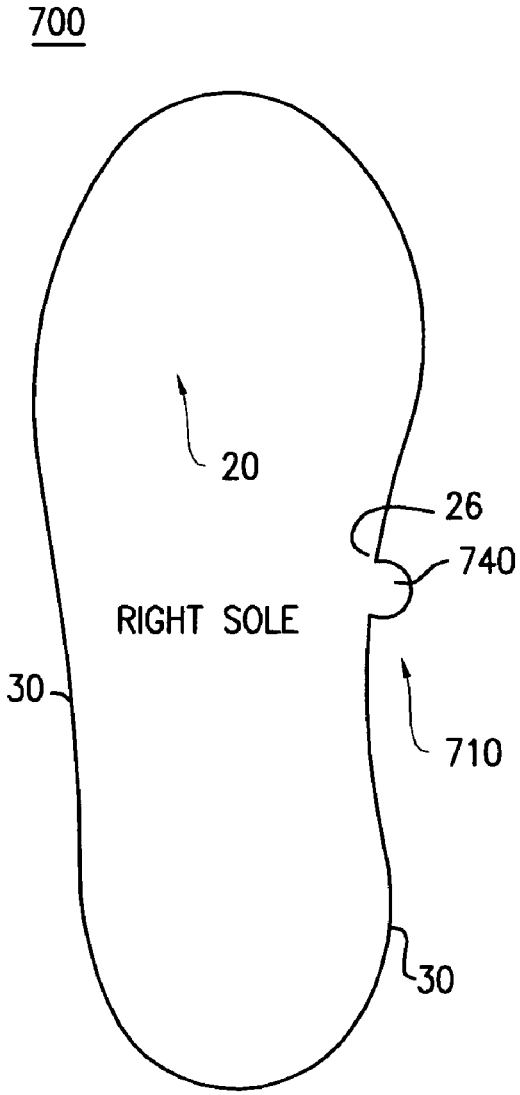
FIG. 11 is a bottom plan view of the hang tabs for footwear of the seventh alternate embodiment of the present invention showing the hang tab positioned on the in-step section of the sole of the right shoe.

The protruding hang tabs 710 for footwear 12 and their component parts of the seventh alternate embodiment 700 is shown in FIG. 11 of the drawings. The elements illustrated in FIG. 11 which correspond to the elements described above with reference to FIGS. 1 and 2 have been designated by corresponding reference numbers being increased by seven hundred. The seventh alternate embodiment 700 is constructed and operates in the same manner as the preferred embodiment 10, unless it is otherwise stated.

With reference to FIG. 11, the tab members 740 of the protruding hang tabs 710 are exactly the same as the preferred embodiment 10 except for the orientation of the tab member 740 on the sole section 20 of footwear 12. Tab member 740 is positioned on the inside section 26 of the sole section 20 of footwear 12.

Eighth Alternate Embodiment 800

Figure 12:
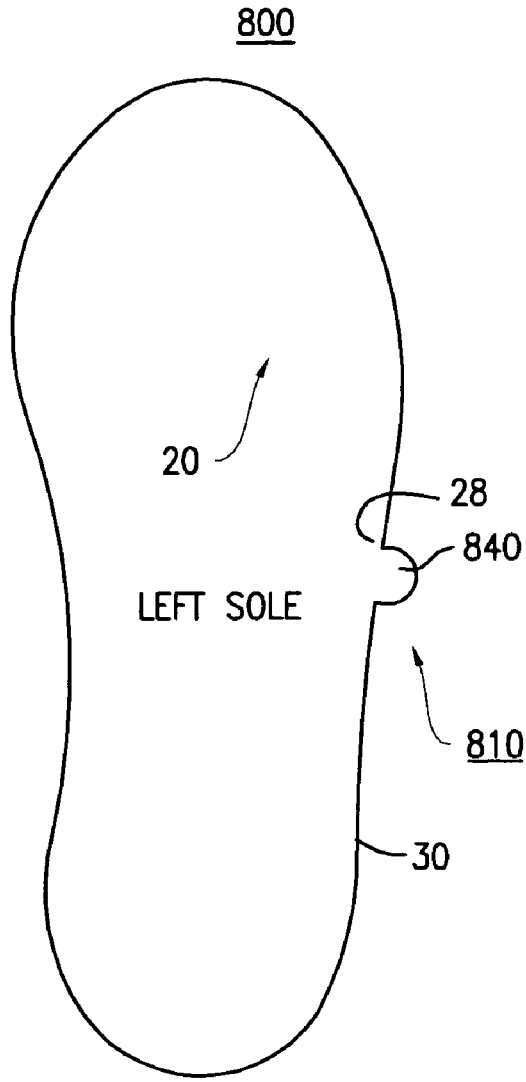
FIG. 12 is a bottom plan view of the hang tabs for footwear of the eighth alternate embodiment of the present invention showing the hang tab positioned on the arch section of the sole of the left shoe.

The protruding hang tabs 810 for footwear 12 and their component parts of the eighth alternate embodiment 800 is shown in FIG. 12 of the drawings. The elements illustrated in FIG. 12 which correspond to the elements described above with reference to FIGS. 1 and 2 have been designated by corresponding reference numbers being increased by eight hundred. The eighth alternate embodiment 800 is constructed and operates in the same manner as the preferred embodiment 10, unless it is otherwise stated.

With reference to FIG. 12, the tab member 840 of the protruding hang tabs 810 are exactly the same as the preferred embodiment 10 except for the orientation of the tab member 840 on the sole section 20 of footwear 12. Tab member 840 is positioned on the outside section 28 of the sole section 20 of footwear 12.

Operation of the Present Invention

In operation, all of the protruding hang tabs 10, 110, 210, 310, 410, 510, 610, 710, and 810 for footwear 12 of the preferred and alternate embodiments 10, 100, 200, 300, 400, 500, 600, 700 and 800 respectively, as shown in FIGS. 1, 2 and 5 to 12 of the patent drawings, operate in a similar manner. As shown in FIG. 1, the paired footwear 12 are in a side by side orientation $S^2$, such that each (footwear) shoe 12 is attached to one side of a display card 16 wherein the tab member 40 on the toe end 22 of each sole section 20 is attached to the display card 16 using a swiftach fastener 18S through each of the tab members 40 of the protruding hang tabs 10 (See FIG. 1). Further, each of the adjacent tab members 40 oriented on the inside sections 26 of opposing sole sections 20 are connected together by a tie and tag fastener 18T having a price tag 14 thereon, as depicted in FIG. 1 of the drawings.

As shown in FIG. 2, the paired footwear 12 are in a back to back orientation $B^2$, such that each (footwear) slipper 12 is attached to opposing sides of a display card 16, wherein the tab members 40 on the toe end 22 of each sole section 20 is attached to the opposing sides of the display card 16 using a swiftach fastener 18S through each of the tab members 40 of the protruding hang tabs 10 (See FIG. 2). Further, each of the tab members 40 oriented on the outside sections 28 of opposing sole sections 20 are connected together by a tie and tag fastener 18T having a price tag 14 thereon, as shown in FIG. 2 of the drawings. Additionally, each of the adjacent tab members 40 oriented on the heel ends 24 of opposing sole sections 20 of opposing slippers 12 are also connected together by a swiftach fastener 18S in order to prevent the unpairing of the attached slippers 12.

All of the remaining embodiments 100, 200, 300, 400, 500, 600, 700 and 800 operate in a similar manner for keeping the paired footwear 12 together.

Advantages of the Present Invention

Accordingly, an advantage of the present invention is that it provides for protruding hang tabs for footwear having molded plastic or rubber soles thereon, wherein the integrally attached protruding hang tabs on the molded plastic or rubber soles are used for receiving fasteners or hangers and/or display cards thereon.

Another advantage of the present invention is that it provides for protruding hang tabs for footwear that are used for either connecting or hanging the paired footwear or slippers together, or for attaching price tags to the protruding hang tabs.

Another advantage of the present invention is that it provides for protruding hang tabs for footwear that are easily cut-off and removed from the sole of the footwear or slipper after the completion of the sale by the consumer leaving little or no visible remnant in the separated footwear or slippers.

Another advantage of the present invention is that it provides for protruding hang tabs which are of durable and reliable construction for the easy addition of swiftach fasteners, tie and tag fasteners and/or chip display cards to the protruding hang tabs according to the display needs of the consumer, store or manufacturer.

Another advantage of the present invention is that it provides for protruding hang tabs for releasably pairing of at least one pair of shoes, slippers, etc. together in a side by side configuration or in a back to back configuration.

Another advantage of the present invention is that it provides for protruding hang tabs that help to keep the footwear organized by permitting two or more paired footwear to be coupled together on a single display card.

Another advantage of the present invention is that it provides for protruding hang tabs that have geometrically-shaped designs such as a semi-circular shape, a rectangular-shape, a triangular-shape, or an oval-shape.

Another advantage of the present invention is that it provides for protruding hang tabs for footwear selected from the group consisting of shoes, slippers, boots, laceless sneakers, booties, and other miscellaneous footwear.

A further advantage of the present invention is that it provides for protruding hang tabs for footwear that can be mass produced in an automated and economical manner and are readily affordable by the store owner or manufacturer.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A pair of shoes each having plastic or rubber soles and having protruding hang tabs from said soles for use in connecting a pair of shoes together, comprising:

a) each of said soles having a plurality of protruding hang tabs integrally formed as part of said sole at spaced-apart positions along a perimeter edging of said sole;

b) each of said soles and said hang tabs being a continuous one-piece element wherein the respective surfaces of said sole and said hang tab being in the same plane;

c) said plurality of hang tabs including a first hang tab positioned on the toe end of said sole, a second hang tab positioned on the heel end of said sole, a third hang tab positioned on the inside section of said sole, and a fourth hang tab positioned on the outside section of said sole;

d) one or more of said hang tabs on each of said soles having fastening means attached thereto for connecting to said hang tabs on adjacent soles for connecting a pair of said soles together; and e) said hang tabs being removable from said soles after purchase of the shoes.

2. Footwear protruding hang tabs in accordance with claim 1, wherein each hang tab is a geometric-shaped hang tab.

3. Footwear protruding hang tabs in accordance with claim 2, wherein said geometric-shaped hang tab is selected from a group consisting of a rectangular shape, a triangular shape, a semi-circular shape and a semi-oval shape.

4. Footwear protruding hang tabs in accordance with claim 1, wherein each of said integrally formed hang tabs is in the same horizontal plane as said sole.

5. Footwear protruding hang tabs in accordance with claim 1, wherein each of said hang tabs is removed from said sole by cutting-off of said hang tabs at said perimeter edging of said sole after purchase.

6. Footwear protruding hang tabs in accordance with claim 1, wherein said fastening means are selected from a group consisting of swiftach fasteners, tie and tag fasteners, plastic tie fasteners and staples.

7. A pair of shoes each having plastic or rubber soles and having protruding hang tabs from said soles for use in connecting a pair of shoes together, comprising:

a) each of said shoes having a pair of protruding hang tabs integrally formed as part of said sole at spaced-apart positions along a perimeter edging of said sole;

b) each of said soles and said hang tabs being a continuous one-piece element, wherein the respective surfaces of said sole and said hang tab being in the same plane;

c) said pair of hang tabs including a first hang tab positioned on the toe end of said sole and a second hang tab positioned on the heel end of said sole;

d) one or more of said hang tabs on each of said soles having fastening means attached thereto for connecting to said hang tabs on adjacent soles for connecting a pair of said soles together; and e) said hang tabs being removable from said soles after purchase of the shoes.

8. Footwear protruding hang tabs in accordance with claim 7, wherein each hang tab is a geometric-shaped hang tab.

9. Footwear protruding hang tabs in accordance with claim 7, wherein each of said integrally formed hang tabs is in the same horizontal plane as said sole.

10. Footwear protruding hang tabs in accordance with claim 7, wherein each of said hang tabs is removed from said sole by cutting-off of said hang tabs at said perimeter edging of said sole after purchase.

11. Footwear protruding hang tabs in accordance with claim 7, wherein said fastening means are selected from a group consisting of swiftach fasteners, tie and tag fasteners, plastic tie fasteners and staples.

12. A pair of shoes each having plastic or rubber soles and having protruding hang tabs from said soles for use in connecting a pair of shoes together, comprising:

a) each of said soles having a pair of protruding hang tabs integrally formed as part of said sole at spaced-apart positions along a perimeter edging of said sole;

b) each of said soles and said hang tabs being a continuous one-piece element, wherein the respective surfaces of said sole and said hang tab being in the same plane;

c) said pair of hang tabs including a first hang tab positioned on the inside section of said sole, and a second hang tab positioned on the outside section of said sole;

d) one or more of said hang tabs on each of said soles having fastening means attached thereto for connecting to said hang tabs on adjacent soles for connecting a pair of said soles together; and e) said hang tabs being removable from said soles after purchase of the shoes.

13. Footwear protruding hang tabs in accordance with claim 12, wherein each hang tab is a geometric-shaped hang tab.

14. Footwear protruding hang tabs in accordance with claim 12, wherein each of said integrally formed hang tabs is in the same horizontal plane as said sole.

15. Footwear protruding hang tabs in accordance with claim 12, wherein each of said hang tabs is removed from said sole by cutting-off of said hang tabs at said perimeter edging of said sole after purchase.

16. Footwear protruding hang tabs in accordance with claim 12, wherein said fastening means are selected from a group consisting of swiftach fasteners, tie and tag fasteners, plastic tie fasteners and staples.

17. A pair of shoes each having plastic or rubber soles and having protruding hang tabs from said soles for use in connecting a pair of shoes together, comprising:

a) each sole having a pair of protruding hang tabs integrally formed as part of said sole at spaced-apart positions along a perimeter edging of said sole;

b) each of said soles and said hang tabs being a continuous one-piece element, wherein the respective surfaces of said sole and said hang tab being in the same plane;

c) said pair of hang tabs including a first hang tab positioned on the toe end of said sole, and a second hang tab positioned on the inside section of said sole;

d) each of said hang tabs on each of said soles having fastening means attached thereto for connecting to said hang tabs on adjacent soles for connecting a pair of said soles together; and e) said hang tabs being removable from said soles after purchase of the shoes.

18. Footwear protruding hang tabs in accordance with claim 17, wherein each hang tab is a geometric-shaped hang tab.

19. Footwear protruding hang tabs in accordance with claim 17, wherein each of said integrally formed hang tabs is in the same horizontal plane as said sole.

20. Footwear protruding hang tabs in accordance with claim 17, wherein each of said hang tabs is removed from said sole by cutting-off of said hang tabs at said perimeter edging of said sole after purchase.

21. Footwear protruding hang tabs in accordance with claim 17, wherein said fastening means are selected from a group consisting of swiftach fasteners, tie and tag fasteners, plastic tie fasteners and staples.

22. A pair of shoes each having plastic or rubber soles and having protruding hang tabs from soles for use in connecting a pair of shoes together, comprising:

a) each sole having a pair of protruding hang tabs integrally formed as part of said sole at spaced-apart positions along a perimeter edging of said sole;

b) each of said soles and said hang tabs being a continuous one-piece element, wherein the respective surfaces of said sole and said hang tab being in the same plane;

c) said pair of hang tabs including a first hang tab positioned on the heel end of said sole, and a second hang tab positioned on the outside section of said sole;

d) one or more of said hang tabs on each of said soles having fastening means attached thereto for connecting to said hang tabs on adjacent soles for connecting a pair of said soles together; and e) said hang tabs being removable from said soles after purchase of the shoes.

23. Footwear protruding hang tabs in accordance with claim 22, wherein each hang tab is a geometric-shaped hang tab.

24. Footwear protruding hang tabs in accordance with claim 22, wherein each of said integrally formed hang tabs is in the same horizontal plane as said sole.

25. Footwear protruding hang tabs in accordance with claim 22, wherein each of said hang tabs is removed from said sole by cutting-off of said hang tabs at said perimeter edging of said sole after purchase.

26. Footwear protruding hang tabs in accordance with claim 22, wherein said fastening means are selected from a group consisting of swiftach fasteners, tie and tag fasteners, plastic tie fasteners and staples.

27. A pair of shoes each having plastic or rubber soles and having protruding hang tabs from said soles for use in connecting a pair of shoes together, comprising:

a) each sole having a protruding hang tab integrally formed as part of said sole at a single position along a perimeter edging of said sole;

b) each of said soles and said hang tabs being a continuous one-piece element, wherein the respective surfaces of said sole and said hang tab being in the same plane;

c) said single hang tab having a first hang tab positioned on the toe end of said sole;

d) said hang tab on each of said soles having fastening means attached thereto for connecting to said hang tabs on adjacent soles for connecting a pair of said soles together; and e) said hang tabs being removable from said soles after purchase of the shoes.

28. Footwear protruding hang tabs in accordance with claim 27, wherein each hang tab is a geometric-shaped hang tab.

29. Footwear protruding hang tabs in accordance with claim 27, wherein each of said integrally formed hang tabs is in the same horizontal plane as said sole.

30. Footwear protruding hang tabs in accordance with claim 27, wherein each of said hang tabs is removed from said sole by cutting-off of said hang tabs at said perimeter edging of said sole after purchase.

31. Footwear protruding hang tabs in accordance with claim 27, wherein said fastening means are selected from a group consisting of swiftach fasteners, tie and tag fasteners, plastic tie fasteners and staples.

32. A pair of shoes each having plastic or rubber soles and having protruding hang tabs from said soles for use in connecting a pair of shoes together, comprising:

a) each sole having a protruding hang tab integrally formed as part of said sole at a single position along a perimeter edging of said sole;

b) each of said soles and said hang tabs being a continuous one-piece element wherein the respective surfaces of said sole and said hang tab being in the same plane;

c) said single of hang tab having a first hang tab positioned on the heel end of said sole;

d) said hang tab on each of said soles having fastening means attached thereto for connecting to said hang tabs on adjacent soles for connecting a pair of said soles together; and e) said hang tabs being removable from said soles after purchase of the shoes.

33. Footwear protruding hang tabs in accordance with claim 32, wherein each hang tab is a geometric-shaped hang tab.

34. Footwear protruding hang tabs in accordance with claim 32, wherein each of said integrally formed hang tabs is in the same horizontal plane as said sole.

35. Footwear protruding hang tabs in accordance with claim 32, wherein each of said hang tabs is removed from said sole by cutting-off of said hang tabs at said perimeter edging of said sole after purchase.

36. Footwear protruding hang tabs in accordance with claim 32, wherein said fastening means are selected from a group consisting of swiftach fasteners, tie and tag fasteners, plastic tie fasteners and staples.

37. A pair of shoes each having plastic or rubber soles and having protruding hang tabs from said soles for use in connecting a pair of shoes together, comprising:

a) each sole having a protruding hang tab integrally formed as part of said sole at a single position along a perimeter edging of said sole;

b) each of said soles and said hang tabs being a continuous one-piece element wherein the respective surfaces of said sole and said hang tab being in the same plane;

c) said single hang tab having a first hang tab positioned on the inside section of said sole;

d) said hang tab on each of said soles having fastening means attached thereto for connecting to said hang tabs on adjacent soles for connecting a pair of said soles together; and e) said hang tabs being removable from said soles after purchase of the shoes.

38. Footwear protruding hang tabs in accordance with claim 37, wherein each hang tab is a geometric-shaped hang tab.

39. Footwear protruding hang tabs in accordance with claim 37, wherein each of said integrally formed hang tabs is in the same horizontal plane as said sole.

40. Footwear protruding hang tabs in accordance with claim 37, wherein each of said hang tabs is removed from said sole by cutting-off of said hang tabs at said perimeter edging of said sole after purchase.

41. Footwear protruding hang tabs in accordance with claim 37, wherein said fastening means are selected from a group consisting of swiftach fasteners, tie and tag fasteners, plastic tie fasteners and staples.

42. A pair of shoes each having plastic or rubber soles and having protruding hang tabs from said soles for use in connecting a pair of shoes together, comprising:

a) each sole having a protruding hang tab integrally formed as part of said sole at a single position along a perimeter edging of said sole;

b) each of said soles and said hang tabs being a continuous one-piece element, wherein the respective surfaces of said sole and said hang tab being in the same plane;

c) said single hang tab having a first hang tab positioned on the outside section of said sole;

d) said hang tab on each of said soles having fastening means attached thereto for connecting to said hang tabs on adjacent soles for connecting a pair of said soles together; and e) said hang tabs being removable from said soles after purchase of the shoes.

43. Footwear protruding hang tabs in accordance with claim 42, wherein each hang tab is a geometric-shaped hang tab.

44. Footwear protruding hang tabs in accordance with claim 42, wherein each of said integrally formed hang tabs is in the same horizontal plane as said sole.

45. Footwear protruding hang tabs in accordance with claim 42, wherein each of said hang tabs is removed from said sole by cutting-off of said hang tabs at said perimeter edging of said sole after purchase.

46. Footwear protruding hang tabs in accordance with claim 42, wherein said fastening means are selected from a group consisting of swiftach fasteners, tie and tag fasteners, plastic tie fasteners and staples.

47. Footwear protruding hang tabs in accordance with claim 27, wherein said hang tabs on each of said adjacent soles are connected to a display card by ties.

48. Footwear protruding hang tabs in accordance with claim 1, wherein at least one of said hang tabs on each of said adjacent soles are connected to a display card by ties.

* * * * *